US006935577B2

(12) United States Patent
Strong

(10) Patent No.: US 6,935,577 B2
(45) Date of Patent: Aug. 30, 2005

(54) ONE-PIECE FLUID NOZZLE

(75) Inventor: Christopher L. Strong, Frederick, CO (US)

(73) Assignee: Illinois Tool Works Inc., Glenview, IL (US)

( * ) Notice: Subject to any disclaimer, the term of this patent is extended or adjusted under 35 U.S.C. 154(b) by 30 days.

(21) Appl. No.: 10/377,011

(22) Filed: Feb. 28, 2003

(65) Prior Publication Data

US 2004/0169093 A1 Sep. 2, 2004

(51) Int. Cl.[7] ..... G05B 7/12; G05B 1/28

(52) U.S. Cl. ..... 239/290; 239/296; 239/424; 239/526

(58) Field of Search ..... 239/290, 296, 239/525, 526, 527, 528, 529, 297, 291, 419.5, 424, 424.5, 425, 418

(56) References Cited

U.S. PATENT DOCUMENTS

| | | | | |
|---|---|---|---|---|
| 1,650,128 A | | 11/1927 | Hubbard | 239/11 |
| 2,246,211 A | | 6/1941 | Kilich | 239/10 |
| 2,303,280 A | * | 11/1942 | Jenkins | 239/296 |
| 3,190,564 A | | 6/1965 | Liedberg | 239/578 |
| 3,734,406 A | | 5/1973 | Runstadler et al. | 239/8 |
| 3,946,947 A | | 3/1976 | Schneider | 239/401 |
| 4,159,082 A | | 6/1979 | Luderer et al. | 239/407 |
| 4,171,096 A | | 10/1979 | Welsh et al. | |
| 4,330,086 A | | 5/1982 | Nysted | 239/8 |
| 4,632,314 A | | 12/1986 | Smith et al. | 239/433 |
| 4,646,968 A | * | 3/1987 | Sablatura | 239/10 |
| 4,899,937 A | | 2/1990 | Haruch | 239/289 |
| 4,944,459 A | | 7/1990 | Watanabe et al. | |
| 5,074,466 A | | 12/1991 | Santiago | 239/8 |
| 5,209,405 A | * | 5/1993 | Robinson et al. | 239/296 |
| 5,249,746 A | * | 10/1993 | Kaneko et al. | 239/296 |
| 5,273,059 A | * | 12/1993 | Gross et al. | 134/57 R |
| 5,344,078 A | * | 9/1994 | Fritz et al. | 239/296 |
| 6,045,057 A | | 4/2000 | Moor et al. | 239/9 |
| 6,085,996 A | * | 7/2000 | Culbertson et al. | 239/290 |
| 6,098,902 A | | 8/2000 | Culbertson et al. | |
| 6,129,295 A | | 10/2000 | Johansson | 239/525 |
| 6,186,273 B1 | * | 2/2001 | Goldbach et al. | 182/128 |
| 6,450,422 B1 | | 9/2002 | Maggio | 239/345 |
| 6,669,112 B2 | | 12/2003 | Reetz, III et al. | 239/296 |
| 2003/0066905 A1 | * | 4/2003 | Huffman | 239/135 |
| 2004/0031860 A1 | | 2/2004 | Micheli | 239/11 |
| 2004/0046040 A1 | * | 3/2004 | Micheli | 239/11 |

FOREIGN PATENT DOCUMENTS

| | | |
|---|---|---|
| DE | 25 22 885 A | 12/1976 |
| DE | 26 22 818 | 12/1977 |
| GB | 280 500 A | 7/1990 |

* cited by examiner

*Primary Examiner*—William C. Doerrler
(74) *Attorney, Agent, or Firm*—Fletcher Yoder

(57) ABSTRACT

A system and method for reducing fluid drainage into air passageways of a spray device during disassembly. The present technique provides an internally mountable fluid nozzle having a fluid inlet, a fluid exit, and a converging central passageway extending substantially between the fluid inlet and the fluid exit. Accordingly, the internally mountable fluid nozzle has a relatively small internal volume, which reduces the amount of fluid that can be spilled during disassembly of the spray device. The present technique also provides a section of the spray device having an air passageway with an air exit, and a protrusive fluid passageway with a fluid exit in a protrusive offset position from the air exit. The internally mountable fluid nozzle can be mounted to the section in fluid communication with the protrusive fluid passageway, such that fluid spillage or drainage during disassembly does not flow into the air passageway. A spray formation section also may be coupled to the section, such that an internal cavity of the spray formation section is disposed about the internally mountable fluid nozzle.

31 Claims, 6 Drawing Sheets

ONE-PIECE FLUID NOZZLE

BACKGROUND OF THE INVENTION

The present technique relates generally to spray systems. More specifically, a technique is provided for reducing fluid drainage into internal passageways and components of a spray device during disassembly.

Spray devices generally have several sections and passageways that operate to create a spray, such as an atomized fluid spray. In many situations, it may be desirable to disassemble the spray device for cleaning, servicing, parts replacement, or other reasons. Unfortunately, residual fluid in the spray device often drains into adjacent air passageways and onto other portions of the spray device during the disassembly process. This fluid drainage is partially attributed to the close proximity of fluid and air passageways, particularly the air passageways extending around a fluid nozzle. The internal volume of the fluid nozzle further contributes to this fluid drainage. For example, existing fluid nozzles often have a relatively long cylindrical passageway leading into a converging fluid passageway. As the fluid nozzle is removed, the residual fluid in the cylindrical and converging passageways can drain into the adjacent air passageways.

In certain applications, spray devices are mounted in a fixed or movable system. For example, one or more spray devices may be mounted in a finishing system, which operates to apply a desired material onto a surface of a target object. In such systems, the mounting position of the spray devices may be particularly important to the spraying process. Unfortunately, existing spray devices are generally mounted directly to the desired system via a screw or bolt. If removal is necessary, then the previous mounting position is lost.

Accordingly, a technique is needed to address one or more of the foregoing problems.

SUMMARY OF THE INVENTION

A system and method for reducing fluid drainage into air passageways of a spray device during disassembly. The present technique provides an internally mountable fluid nozzle having a fluid inlet, a fluid exit, and a converging central passageway extending substantially between the fluid inlet and the fluid exit. Accordingly, the internally mountable fluid nozzle has a relatively small internal volume, which reduces the amount of fluid that can be spilled during disassembly of the spray device. The present technique also provides a section of the spray device having an air passageway with an air exit, and a protrusive fluid passageway with a fluid exit in a protrusive offset position from the air exit. The internally mountable fluid nozzle can be mounted to the section in fluid communication with the protrusive fluid passageway, such that fluid spillage or drainage during disassembly does not flow into the air passageway. A spray formation section also may be coupled to the section, such that an internal cavity of the spray formation section is disposed about the internally mountable fluid nozzle.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

As discussed in further detail below, the present technique provides a unique spray device having features that facilitate disassembly, servicing, and repeatable mounting in substantially the same spray position. For example, the spray device of the present technique has various structural features that reduce the likelihood of fluid drainage into undesirable areas of the spray device during disassembly and servicing. The present spray device also has a unique mounting mechanism, which preserves the desired mounting position for the spray device in the event of dismounting and subsequent remounting of the spray device.

Figure 1:
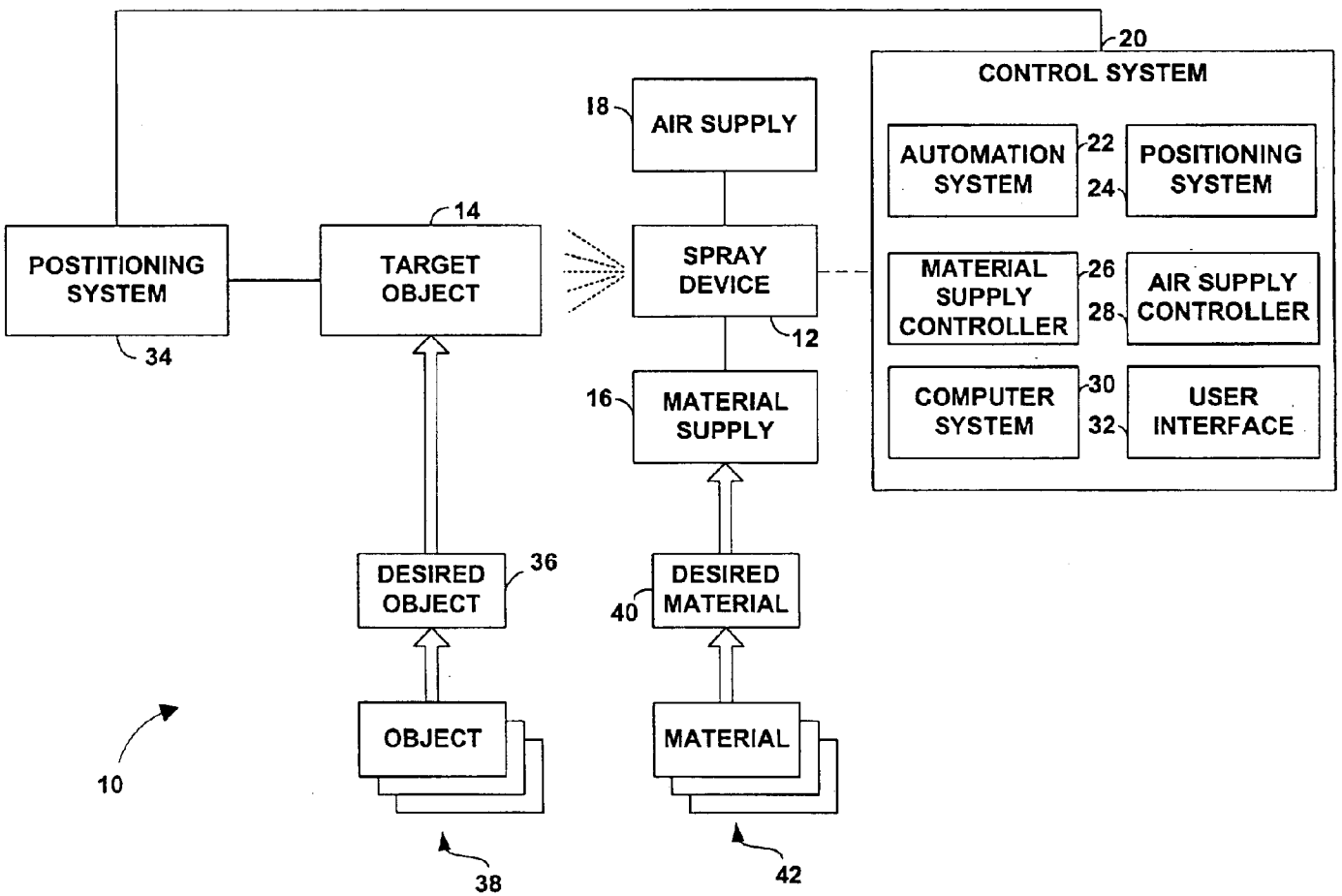
FIG. 1 is a diagram illustrating an exemplary spray system having a spray device in accordance with certain embodiments of the present technique.

Turning now to the figures, FIG. 1 is a flow chart illustrating an exemplary spray system 10, which comprises a spray device 12 for applying a desired material to a target object 14. For example, the spray device 12 may comprise an air atomizer, a rotary atomizer, an electrostatic atomizer, or any other suitable spray formation mechanism. The spray device 12 also may comprise an automatic triggering or on/off mechanism, such as a pressure-activated valve assembly. The spray device 12 may be coupled to a variety of supply and control systems, such as a material supply 16 (e.g., a fluid or powder), an air supply 18, and a control system 20. The control system 20 facilitates control of the material and air supplies 16 and 18 and ensures that the spray device 12 provides an acceptable quality spray coating on the target object 14. For example, the control system 20 may include an automation system 22, a positioning system 24, a material supply controller 26, an air supply controller 28, a computer system 30, and a user interface 32. The control system 20 also may be coupled to a positioning system 34, which facilitates movement of the target object 14 relative to the spray device 12. For example, either one or both of the positioning systems 24 and 34 may comprise an assembly line, a hydraulic lift, a robotic arm, and a variety of other positioning mechanisms controlled by the control system 20. Accordingly, the spray system 10 may provide a computer-controlled spray pattern across the surface of the target object 14.

The spray system 10 of FIG. 1 is applicable to a wide variety of applications, materials, target objects, and types/configurations of the spray device 12. For example, a user may select a desired object 36 from a variety of different objects 38, such as different material and product types. The user also may select a desired material 40 from a plurality of different materials 42, which may include different material types and characteristics for a variety of materials such as metal, wood, stone, concrete, ceramic, fiberglass, glass, living organisms, and so forth. For example, the desired material 40 may comprise paints, stains, and various other coating materials, such as furniture coatings, vehicle coatings, industrial product coatings, and consumer product coatings. By way of further example, the desired material 40 may comprise a porcelain enamel, a ceramic glaze, or another ceramic coating material, which may be applied to toilets, sinks, water heaters, washing machines, dinner plates and bowls, and so forth. The desired material 40 also may comprise insecticides, fungicides, and various other chemical treatments. In addition, the desired material 40 may have a solid form (e.g., a powder), a fluid form, a multi-phase form (e.g., solid and liquid), or any other suitable form.

Figure 2:
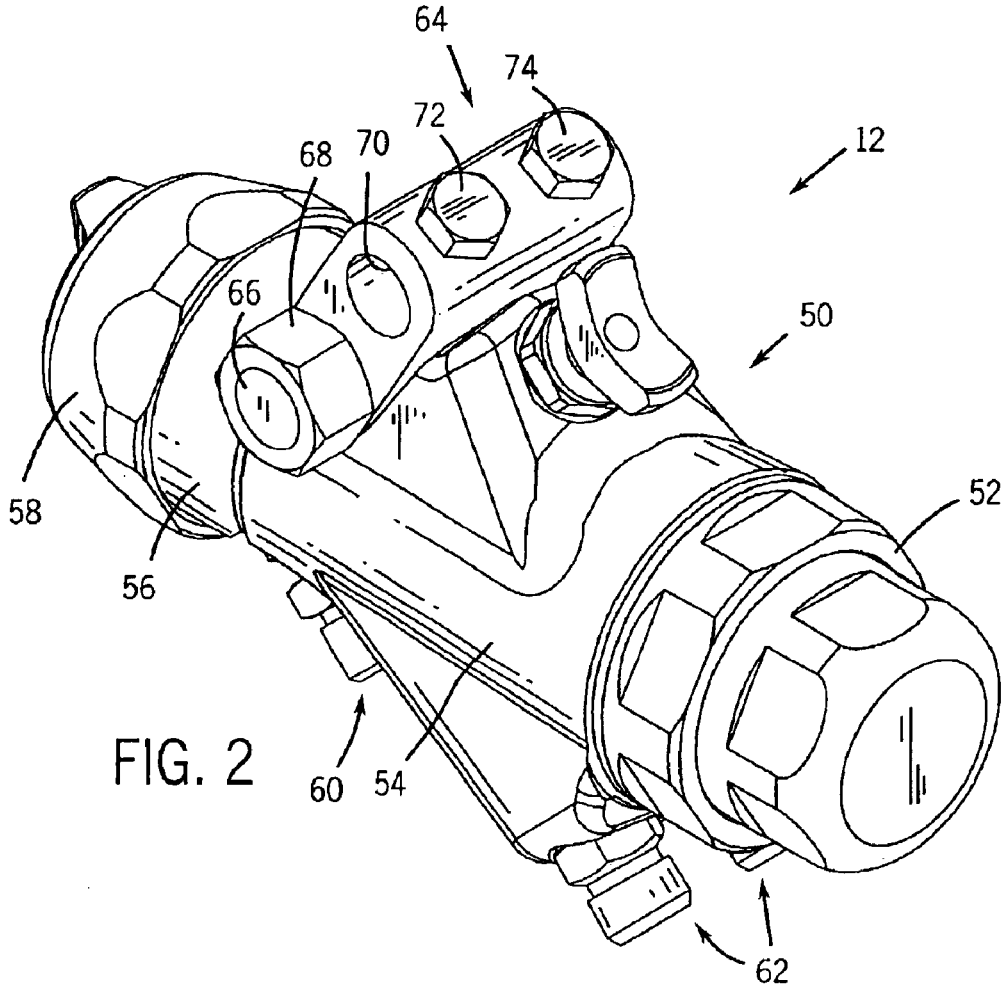
FIG. 2 is a perspective view of an exemplary embodiment of the spray device illustrated in FIG. 1.

FIG. 2 is a perspective view illustrating an exemplary embodiment of the spray device 12. As illustrated, the spray device 12 comprises a body 50 having a base section 52, a mid-section 54 coupled to the base section 52, a head section 56 coupled to the mid-section 54, and a spray formation section 58 coupled to the head section 56. Fluid inlet 60 and air inlet 62 also extend into the body 50, thereby feeding a desired fluid and air into the spray device 12 to form a desired spray via the head and spray formation section 56 and 58. As discussed above, the spray device 12 may comprise any suitable fluid atomizing mechanisms, air valves, fluid valves, spray shaping mechanisms (e.g., air shaping jets or ports), and so forth. The spray device 12 also may be automatically activated or triggered, such as by a pressure-activated valve.

In the illustrated embodiment, the spray device 12 also comprises a releasable mount 64 that is releasably coupled to the body 50 via a fastening mechanism, such as an externally threaded fastener 66 and an internally threaded fastener 68. Other suitable tool-free or tool-based fasteners are also within the scope of the present technique. For example, the releasable mount 64 may be coupled to the body 50 via a latch, a spring-loaded mechanism, a retainer member, a compressive-fit mechanism, an electro-mechanical latch mechanism, a releasable pin, a releasable joint or hinge, and so forth. The releasable mount 64 also comprises an external mounting mechanism, such as a mounting receptacle 70 and mounting fasteners or set screws 72 and 74 extending into the mounting receptacle 70. As discussed in further detail below, the spray device 12 may be mounted to a desired stationary or movable positioning system by extending a mounting member or rod into the mounting receptacle 70 and securing the releasable mount 64 to the mounting member via the mounting fasteners or set screws 72 and 74. The spray device 12 can be dismounted by either disengaging the mounting fasteners 72 and 74 from the mounting member or by disengaging the fasteners 66 and 68 from the body 50 of the spray device 12. In this exemplary embodiment, the latter approach may be used to preserve the desired mounting position of the releasable mount 64 on the mounting member. Accordingly, if the spray device 12 is removed for maintenance, replacement, or other purposes, then the releasable mount 64 remains attached to the mounting member to ensure that the spray device 12 or its substitute can be reattached in the same or substantially the same mounting position.

Figure 3:
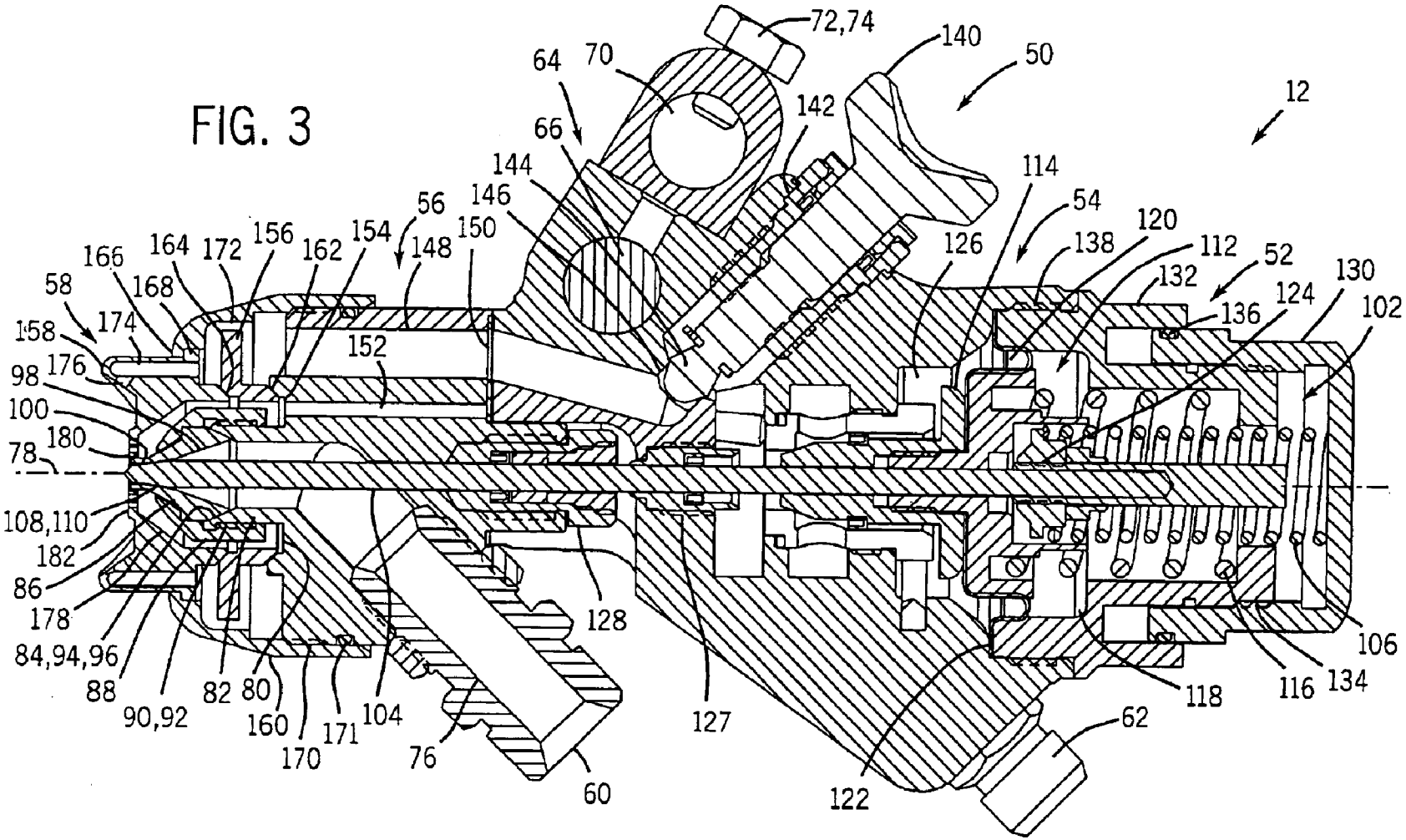
FIG. 3 is a cross-sectional side view illustrating exemplary internal passageways and flow control components of the spray device illustrated in FIG. 2.

Turning now to the internal features, FIG. 3 is a cross-sectional side view of the spray device 12 illustrating exemplary flow passageways, flow control mechanisms, and spray formation mechanisms. As illustrated, a fluid passageway 76 extends angularly into the head section 56 to a longitudinal centerline 78, where the fluid passageway 76 aligns with the longitudinal centerline 78 and continues to a front portion 80 of the head section 56. At the front portion 80, the fluid passageway 76 extends outwardly from the front portion 80 to form a protrusive fluid passageway 82 having a fluid exit 84 that is longitudinally offset from the front portion 80. As illustrated, a fluid nozzle 86 is removably coupled to the protrusive fluid passageway 82 at the fluid exit 84 via a retainer 88, which may comprise an annular structure having internal threads 90 engaged with external threads 92 of the protrusive fluid passageway 82. The illustrated fluid nozzle 86 comprises an inwardly angled inlet surface 94 abutted against an outwardly angled exit surface 96 of the protrusive fluid passageway 82, thereby forming a compressive fit or wedged seal as the retainer 88 is threadably engaged with the protrusive fluid passageway 82. Alternatively, the fluid nozzle 86 may be coupled to the protrusive fluid passageway 82 by a variety of other seal members (e.g., an o-ring), compressive fit mechanisms, threaded engagements, seal materials, and so forth. The fluid nozzle 86 also has a converging inner passageway 98, which extends outwardly from the inwardly angled inlet surface 94 toward an annular fluid exit 100.

It should be noted that the fluid nozzle 86 may comprise a one-piece structure formed via a molding process, a machining process, or any other suitable manufacturing process. However, any other multi-sectional structure and assembly process is within the scope of the present technique. The illustrated fluid nozzle 86 also has a relatively small internal volume defined substantially by the converging inner passageway 98. As discussed in further detail below, the foregoing protrusive fluid passageway 82 and converging inner passageway 98 may provide certain benefits. For example, the passageways 82 and 98 may reduce drainage or spillage of fluids into other portions of the spray device 12 during servicing, maintenance, and other functions in which the fluid nozzle is removed from the protrusive fluid passageway 82.

As illustrated in FIG. 3, the spray device 12 also comprises a fluid valve assembly 102 having a needle or valve member 104 extending through the body 50 from the base 52, through the mid-section 54, through the head section 56, and into the spray formation section 58. In the base section 52, the fluid valves assembly 102 has a valve spring 106, which springably biases the valve member 104 outwardly from the base section 52 toward the spray formation section 58, where a wedged tip 108 of the valve member 104 compressively seals against a corresponding internal portion 110 of the converging inner passageway 98 of the fluid nozzle 86. The fluid valve assembly 102 also comprises a pressure-biasing mechanism or piston assembly 112 to facilitate inward opening of the valve member 104 relative to the fluid nozzle 86. The pressure biasing mechanism or piston assembly 112 comprises a valve piston 114 disposed about the valve member 104, a piston biasing spring 116 disposed in a chamber 118 of the base section 52 around the valve spring 106, and an air diaphragm 120 extending about the valve piston 114 and across the chamber 118 to an abutment edge 122 between the base section 52 and the mid-section 54. Other pressure biasing mechanisms are also within the scope of the present technique. For example, the piston assembly 112 may embody a piston disposed sealingly against an internal wall of a cylinder.

As further illustrated in FIG. 3, the piston biasing spring 116 springably forces the valve piston 114 outwardly from the base section 52 toward the middle section 54. In this outwardly biased position, the valve piston 114 is disengaged from a valve engagement member 124 coupled to the valve member 104. If air is supplied from one of the air inlets 62 to an internal air passageway 126, then the air pressurably biases the air diaphragm 120 and corresponding valve piston 114 with sufficient force to overcome the spring force of the piston biasing spring 116. Accordingly, the valve piston 114 moves inwardly from the mid-section 54 to the base section 52. As the air pressure forces the valve piston 114 inwardly against the valve engagement member 124, the air pressure further overcomes the spring force of the valve spring 106. Accordingly, the valve piston 114 pressurably biases the valve engagement member 124 and corresponding valve vendor member 104 inwardly from the mid-section 54 into the base section 52, thereby moving the valve member 104 and corresponding wedged tip 108 inwardly away from the internal portion 110 of the fluid nozzle 86 to an open position. Although illustrated as an inwardly opening valve, the valve assembly 102 may comprise an outwardly opening valve, an independent internal valve, an independent external valve, or any other suitable valve configuration. Moreover, the valve assembly 102 may comprise any suitable manual or automatic valve mechanism, such as a piston-cylinder assembly, an electro-mechanical valve mechanism, a magnetically activated valve, and so forth.

The various sections, internal passageways, and structures of the spray device 12 are intercoupled and sealed via threads, seals, o-rings, gaskets, compressive fit mechanisms, packing assemblies, and so forth. For example, as illustrated in FIG. 3, the spray device 12 comprises an air packing assembly 127 and a fluid packing assembly 128 disposed about the valve member 104 between the internal air passageway 126 and the fluid passageway 76. In addition, the base section 52 comprises an outer annular structure or cap 130 threadably coupled and sealed to an inner annular structure 132 via threads 134 and o-ring or seal member 136, respectively. The inner annular structure 132 is threadably coupled and sealed to the mid-section 54 via threads 138 and a portion of the air diaphragm 120 disposed within the abutment edge 122 between the base section 52 and the mid section 54. Additional seals also may be provided within the scope of the present technique.

In the mid-section 54, the spray device 12 also comprises an air valve or flow control mechanism 140, which is mounted in a receptacle 142 extending angularly into the mid-section 54. As illustrated, the flow control mechanism 140 comprises a protruding valve member 144, which releasably seals against an annular opening 146 extending into an air passageway 148 between air passageways 126 and 148. Accordingly, the flow control mechanism 140 provides control over the airflow into the head section 56 and the spray formation section 58 via the air passageway 148. The illustrated spray device 12 also has a gasket 150 disposed between the mid-section 54 and the head section 56, thereby creating an airtight seal between the two sections and about the air passageways extending between the two sections. Additional seals also may be provided within the scope of the present technique.

The head section 56 also comprises an air passageway 152 extending from the mid-section 54 to the front portion 80, such that an air exit 154 of the air passageway 152 is longitudinally offset from the fluid exit 84 of the protrusive fluid passageway 82. In the event that the fluid nozzle 86 is removed from the protrusive fluid passageway 82, the foregoing longitudinal offset distance between the fluid and air exits 84 and 154 substantially reduces or eliminates the fluid drainage or spillage into the air passageway 152 and other portions of the spray device 12.

Turning now to the spray formation section 58, various flow passageways and flow enhancing structures are illustrated with reference to FIG. 3. As illustrated, the spray formation section 58 comprises an internal air deflector ring 156, a front air cap 158 disposed adjacent the internal air deflector ring 156, and an external retainer ring 160 removably coupled to the head section 56 and disposed about the internal air deflector ring 156 and the front air cap 158. The internal air deflector ring 156 is sealed against the front portion 80 of the head section 56 via a compressive fit or wedged interface 162. Similarly, the front air cap 158 is sealed against the internal air deflector ring 156 via a compressive fit or wedged interface 164. Finally, the external retainer ring 160 comprises an inward lip 166 that catches and seals against an outward lip 168 of the front air cap 158. As the external retainer ring 160 is threadably secured to the head section 56 via threads 170, the external retainer ring 160 compresses the front air cap 158, the internal air deflector ring 156, and the head section 56 toward one another to create a compressive or wedged seal at each of the wedged interfaces 162 and 164. As illustrated, a seal member or o-ring 171 also may be provided between the external retainer ring 160 and the head section 56 adjacent the threads 170.

In assembly, the various components of the spray formation section 58 also define various passageways to facilitate atomization of the fluid exiting from the fluid nozzle 86. As illustrated, the internal air deflector ring 156, the front air cap 158, and the external retainer ring 116 collectively define a U-shaped or curved air passageway 172, which extends from the air passageway 148 in the head section 56 to air cap passageways 174 in the front air cap 158. The air cap passageways 174 further extend into air shaping ports or jets 176, which are directed inwardly toward the centerline 78 to facilitate a desired spray shape. The internal air deflector ring 156 and the front air cap 158 also define an interior air passageway 178 about the protrusive fluid passageway 82, the fluid nozzle 86, and the retainer 88. As illustrated, the interior air passageway 178 extends from the air passageway 152 in the head section 56 to a plurality of air atomizing ports or jets 180 in a front section 182 of the front air cap 158. These air atomizing ports or jets 180 are disposed about the annular fluid exit 100 of the fluid nozzle 86, such that the air atomizing ports or jets 180 facilitate atomization of the fluid exiting from the fluid nozzle 86. Again, as the spray device 12 creates a fluid spray, the air shaping ports or jets 176 facilitate a desired spray shape or pattern, such as a flat spray, a wide conical spray pattern, a narrow conical spray pattern, and so forth.

Figure 4:
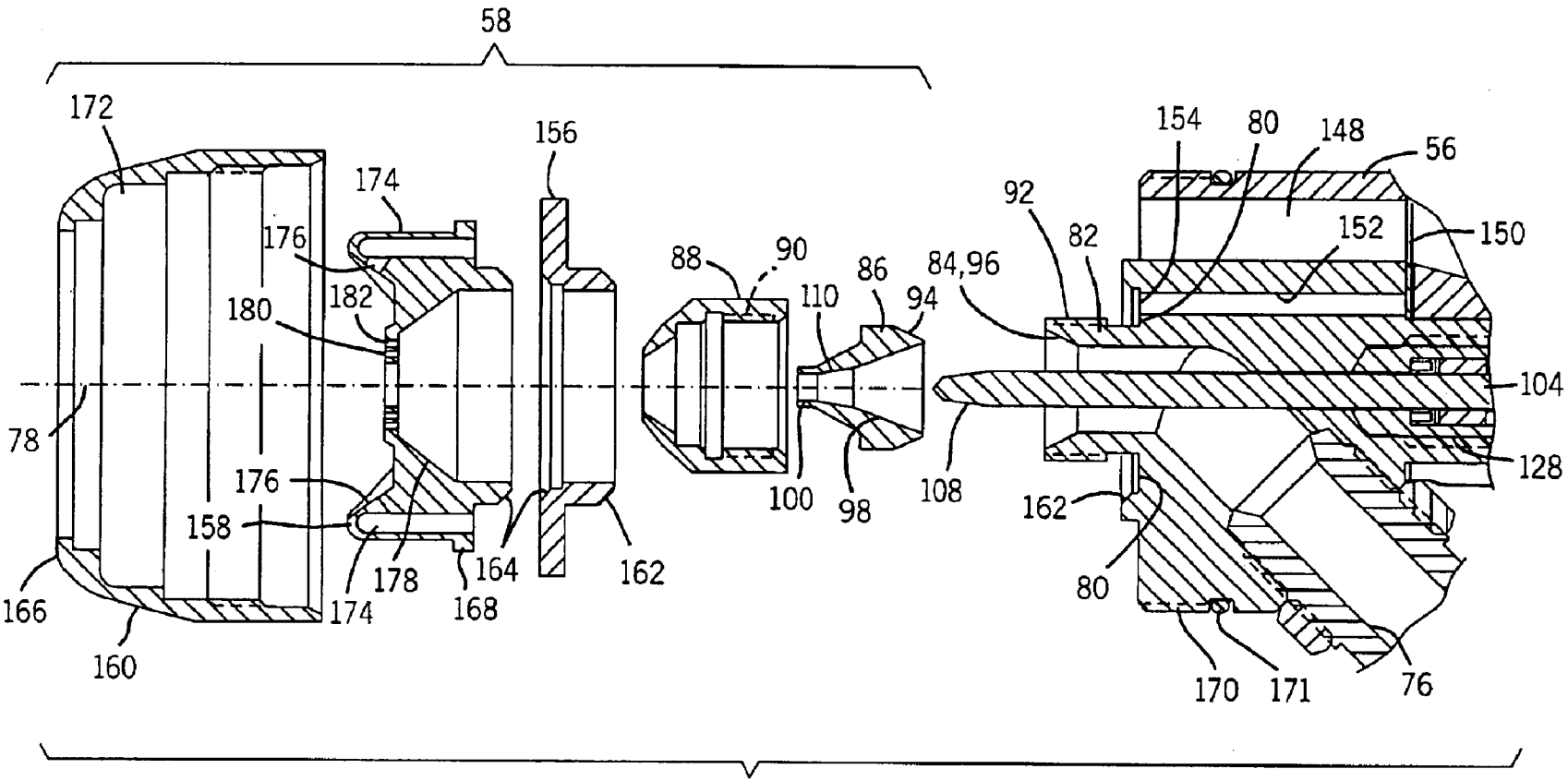
FIG. 4 is a partial cross-sectional side view illustrating an exemplary spray formation section of the spray device illustrated in FIGS. 2 and 3.

FIG. 4 is an exploded cross-sectional side view of the head and spray formation sections 56 and 58 illustrating exemplary features of the spray device 12 of the present technique. It is expected that the spray device 12 may undergo cleaning, servicing, maintenance, part replacements, and other functions in which the spray formation section 58 is removed from the head section 56, as illustrated in FIG. 4. For example, after operation of the spray device 12, the spray formation section 58 may be removed to facilitate cleaning of the fluid nozzle 86 and other internal passageways of the spray device 12. In contrast to previous designs, the foregoing and other functions may be performed more expeditiously and cleanly by way out of the protrusive fluid passageway 82, the segregation of the fluid and air exits 84 and 154, and the relatively small internal volume of the fluid nozzle 86. For example, if the fluid passageway 76 and the fluid nozzle 86 contain residual fluids following use of the spray device 12, then the protrusive fluid passageway 82 and the segregation of the fluid and air exits 84 and 154 prevent drainage or spillage of fluids into the air passageway 152 during removal of the fluid nozzle 86 from the head section 56. Moreover, the relatively small internal volume of the fluid nozzle 86 defined by the converging air passageway 98 also substantially reduces the amount of fluids that drain from the fluid nozzle 86 during its removal from the head section 56. The fluid nozzle 86 of the present technique can also be cleaned more expeditiously than previous designs, because the fluid nozzle 86 has a smaller internal surface area and a shallower depth. For the same reasons, the fluid nozzle 86 of the present technique may be manufactured and replaced at a relatively lower cost than previous designs.

Figure 5:
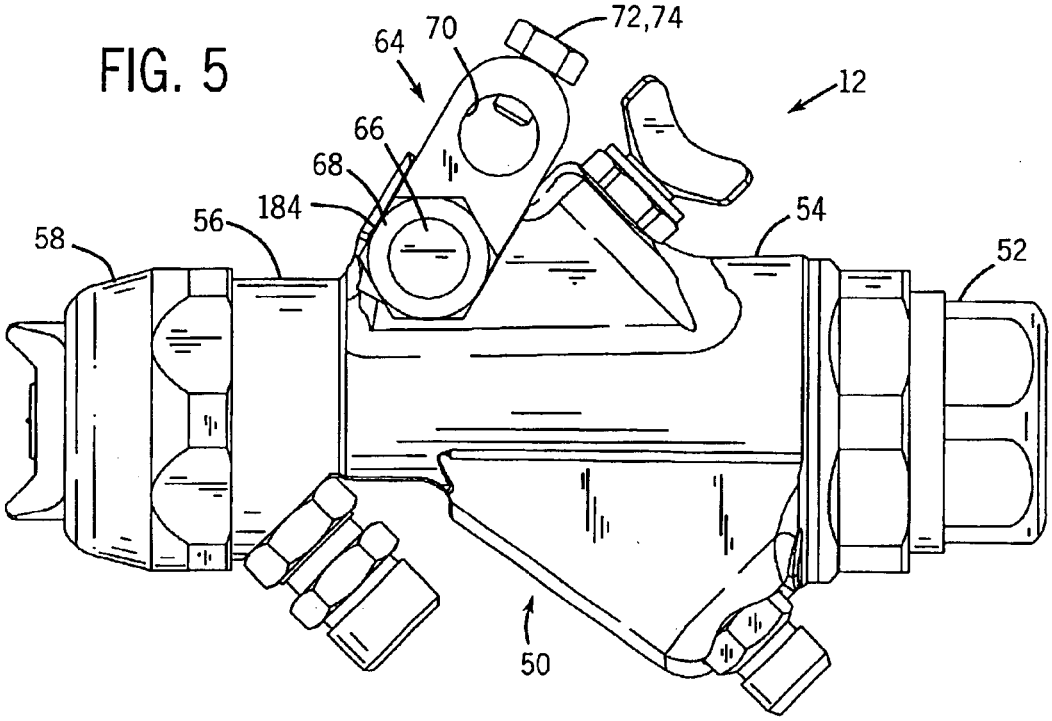
FIG. 5 is a side view illustrating an exemplary releasable mount of the spray device illustrated in FIG. 1.

Turning now to FIG. 5, a side view of the spray device 12 is provided for better illustration of the releasable mount 64. The releasable mount 64 is removably coupled to an upper portion 184 of the body 50 via the externally and internally threaded fasteners 66 and 68. However, any other suitable tool-free or tool-based fasteners may be used within the scope of the present technique. As illustrated, the mounting fasteners or set screws 72 and 74 are threadable into the mounting receptacle 70, such that the releasable mount 64 can be releasably coupled to a desired stationary or mobile device. It should be noted that one or both ends of the releasable mount 64, i.e., at fastener 66 and mounting receptacle 70, may be rotatable or pivotal, such that the spray device 12 can be rotated to a desired orientation. In the illustrated embodiment, the tightness of the fasteners 66, 68, 72, and 74 controls the rotatability of the spray device 12 and the releasable mount 64. If the fasteners 66 and 68 tightly secure the spray device 12 to the releasable mount 64, then the spray device 12 may not be rotatable about the releasable mount 64. Similarly, if the mounting fasteners or set screws 72 and 74 tightly engage the desired stationary or mobile device, then the releasable mount 64 may not be rotatable about that device.

Figure 6:
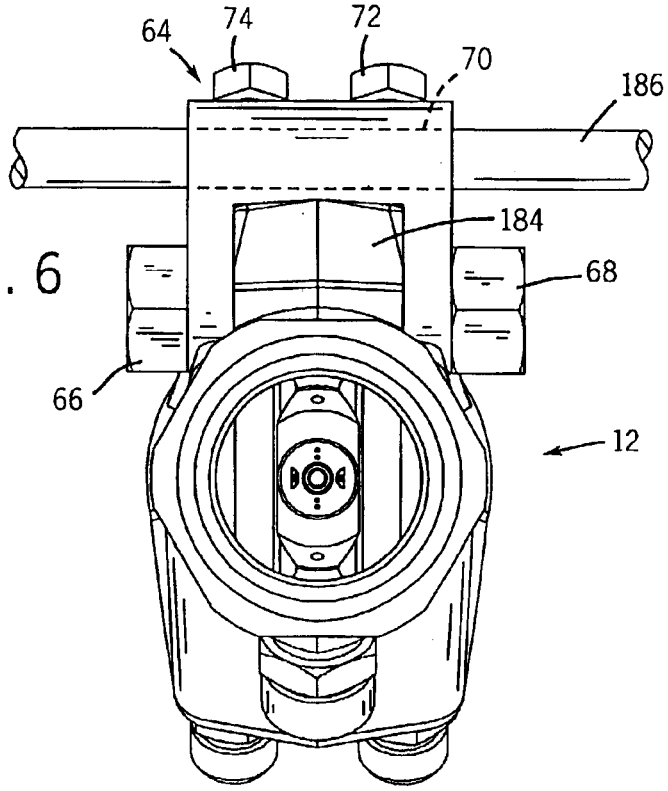
FIG. 6 is a front view illustrating the spray device mounted to a mounting member via the releasable mount illustrated in FIG. 5.

FIG. 6 is a front view of the spray device 12 releasably coupled to a mounting member or rod 186 of such a stationary or mobile device. For example, the mounting member or rod 186 may extend from a robotic arm, an assembly line, a fixed positioning structure, a fixed rod or member, a rail mechanism, a cable and pulley assembly, a hydraulic assembly, a movable positioning structure, or any other suitable structure. Referring back to FIG. 1, the mounting member or rod 186 may be an integral portion of the positioning system 24. The spray device 12 may be mounted to the mounting member or rod 186 by receiving the mounting member or rod 186 into the mounting receptacle 70, adjusting the spray device 12 to the desired spraying position, and then securing the desired position by threading the mounting fasteners or set screws 72 and 74 into the mounting receptacle 70 to contact the mounting member or rod 186.

Figure 7:
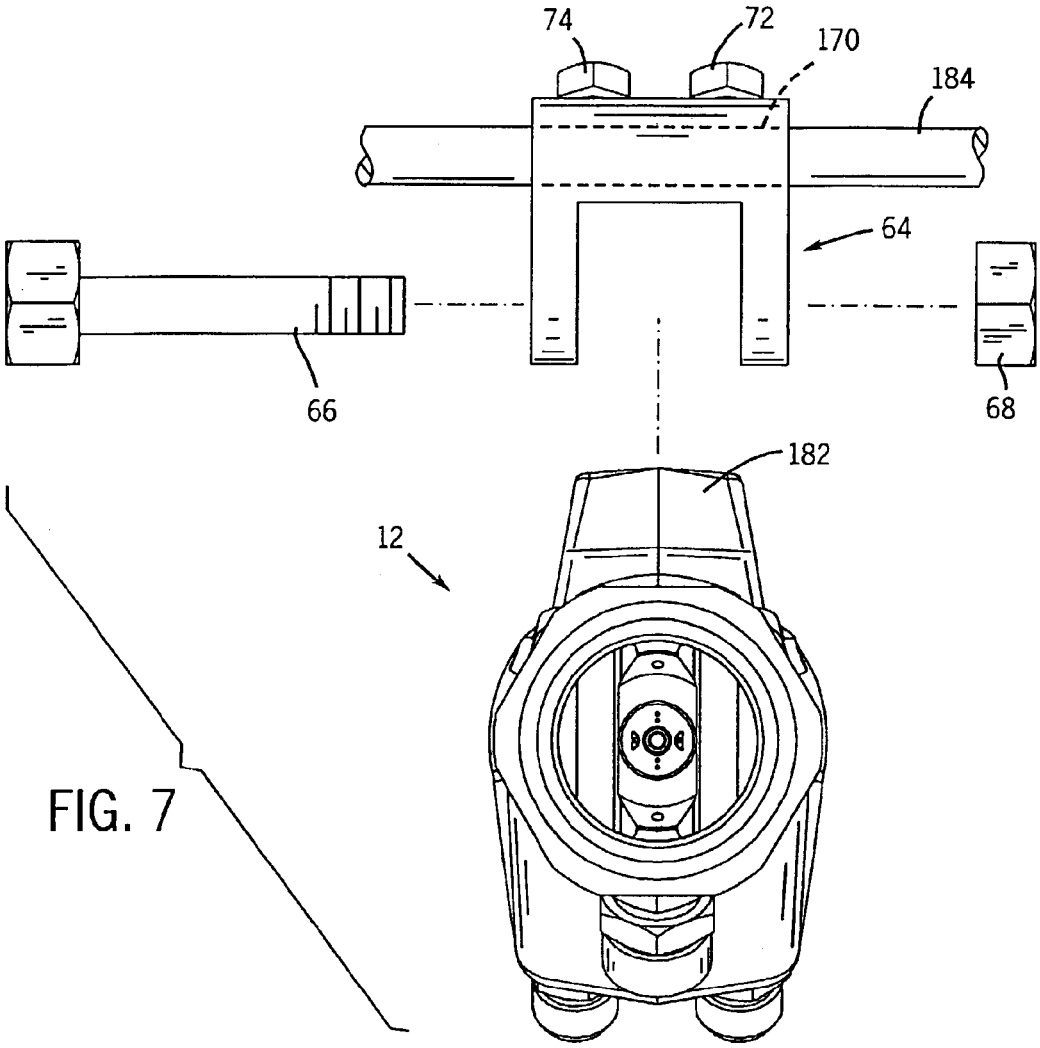
FIG. 7 is an exploded front view illustrating the spray device dismounted from the mounting member of FIG. 6.

The spray device 12 can be dismounted by either disengaging the mounting fasteners 72 and 74 from the mounting member or rod 186 or by disengaging the fasteners 66 and 68 from the body 50 of the spray device 12. FIG. 7 is a front view of the spray device 12 exploded from the releasable mount 64. As illustrated, the releasable mount 64 is preserved in its mounting position on the mounting member or rod 186, such that the spray device 12 or its substitute may be returned to the original mounting position. For example, the spray device 12 may be removed for servicing, cleaning, maintenance, parts replacement, or other purposes. Given the sensitivity of spray processes to positioning of the spray device, the releasable mount 64 of the present technique facilitates repeatable positioning, repeatable spray patterns, and repeatable spray results for the spray device 12 and the system 10. Again, other releasable mounting mechanisms are within the scope of the present technique.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A spray device, comprising:

an air passageway having an air exit at an interior surface;

a protrusive fluid passageway extending outwardly from the interior surface and having a fluid exit offset from the air exit;

a removable fluid nozzle disposed in fluid communication with the fluid exit; and a removable spray formation structure having an internal cavity disposed about the removable fluid nozzle.

2. The spray device of claim 1, wherein the removable fluid nozzle comprises a one-piece structure having a converging fluid passageway.

3. The spray device of claim 1, wherein the removable fluid nozzle comprises an internal volume substantially defined by a converging fluid passageway.

4. The spray device of claim 1, comprising a fluid valve in fluid communication with the removable fluid nozzle.

5. The spray device of claim 4, wherein the fluid valve comprises an inwardly opening valve member extending into the removable fluid nozzle.

6. The spray device of claim 1, wherein the internal cavity defines a second air passageway disposed about the protrusive fluid passageway and the removable fluid nozzle.

7. The spray device of claim 6, comprising an air jet extending from the second air passageway adjacent a nozzle fluid exit of the removable fluid nozzle.

8. The spray device of claim 1, wherein the removable spray formation structure comprises at least one air shaping jet.

9. A spray system, comprising:

a spray device, comprising:

a first section comprising fluid and air exits longitudinally offset from one another;

a removable fluid nozzle disposed in fluid communication with the fluid exit; and a second section disposed about the removable fluid nozzle and removably coupleable to the first section, wherein the second section comprises an air passageway in pneumatic communication with the air exit.

10. The spray system of claim 9, wherein the fluid exit is disposed on a protrusive fluid passageway extending outwardly from a surface having the air exit.

11. The spray system of claim 9, wherein the removable fluid nozzle comprises an internal volume substantially defined by a converging fluid passageway.

12. The spray system of claim 9, wherein the air passageway is disposed between an internal cavity of the second section and an external portion of the removable fluid nozzle.

13. The spray system of claim 9, comprising a positioning system coupled to the spray device.

14. The spray system of claim 13, wherein the positioning system comprises a fixed positioning structure.

15. The spray system of claim 13, wherein the positioning system comprises a movable positioning mechanism.

16. The spray system of claim 9, comprising an automation system coupled to the spray device.

17. The spray system of claim 9, wherein the spray device is adapted to spray a ceramic coating material.

18. The spray system of claim 9, wherein the spray device is adapted to spray a wood finishing material.

19. The spray system of claim 9, wherein the spray device is adapted to spray a paint.

20. The spray system of claim 9, wherein the spray device is adapted to spray a chemical treatment material.

21. A method of manufacturing a spray device, comprising:

providing a first section comprising fluid and air exits longitudinally offset from one another;

fluidly coupling a removable fluid nozzle with the fluid exit;

positioning a second section about the removable fluid nozzle; and pneumatically coupling an air passageway of the second section with the air exit.

22. The method of claim 21, wherein providing the first section comprises forming a protrusive fluid passageway having the fluid exit longitudinally offset from a surface having the air exit.

23. The method of claim 21, comprising providing the removable fluid nozzle with an internal volume substantially defined by a converging fluid passageway.

24. The method of claim 21, wherein fluidly coupling the removable fluid nozzle comprises forming a substantially watertight seal between the removable fluid nozzle and the fluid exit.

25. The method of claim 24, wherein forming the substantially watertight seal comprises compressing a wedged interface between the removable fluid nozzle and the fluid exit.

26. The method of claim 21, wherein positioning the second section comprises enclosing the removable fluid nozzle within an internal cavity of the second section.

27. A spray device, comprising:

a section, comprising:

an air passageway having an air exit; and a protrusive fluid passageway adapted to support a fluid nozzle in a protrusive offset position from the air exit, wherein the section is adapted to coupled with a spray formation section having an internal cavity for the fluid nozzle.

28. The spray device of claim 27, comprising the fluid nozzle having a converging fluid passageway in fluid communication with a fluid exit of the protrusive fluid passageway.

29. The spray device of claim 28, wherein the converging fluid passageway extends substantially from a fluid inlet of the fluid nozzle to the fluid exit.

30. The spray device of claim 28, comprising the spray formation section coupled to the section and disposed about the fluid nozzle.

31. The spray device of claim 27, comprising the spray formation section coupled to the section and having a second air passageway in pneumatic communication with the air exit.

* * * * *